United States Patent [19]

Davis, Jr.

[11] Patent Number: 4,808,236

[45] Date of Patent: Feb. 28, 1989

[54] UNITARY DISHWASHING PRODUCT COMPRISING DETERGENT BLOCK IN CONTAINER AND USE THEREOF

[75] Inventor: Clyde V. Davis, Jr., Decatur, Ga.

[73] Assignee: Diversey Corporation, Ontario, Canada

[21] Appl. No.: 114,766

[22] Filed: Oct. 30, 1987

[51] Int. Cl.[4] ..... B08B 9/04; C11D 17/00

[52] U.S. Cl. ..... 134/25.2; 252/90; 252/99; 252/135; 220/429; 206/77.1

[58] Field of Search ..... 252/90, 99, 135, 103, 252/134, 92; 134/25.2; 220/429; 206/77.1

[56] References Cited

U.S. PATENT DOCUMENTS

| | | | |
|---|---|---|---|
| 2,920,417 | 1/1960 | Wesrheimer | 252/92 |
| 4,569,780 | 2/1986 | Fernholz et al. | 252/92 |
| 4,569,781 | 2/1986 | Fernholz et al. | 252/92 |
| 4,588,080 | 5/1986 | Ginn | 252/92 |
| 4,618,444 | 10/1986 | Hudson et al. | 252/92 |
| 4,652,390 | 3/1987 | Strampach et al. | 252/92 |

*Primary Examiner*—Josephine Barr

*Attorney, Agent, or Firm*—Marshall, O'Toole, Gerstein, Murray & Bicknell

[57] ABSTRACT

A product comprising a container having a closed top, side wall and open mouth bottom; a removable lid closing the container open mouth bottom; an opening in the container top; a tab removably closing the opening in the container top; and a solid detergent composition in the container having a shape conforming to the internal volume defined by the container top and a substantial height of the side wall extending downwardly from the top.

A method of washing dishes and utensils in a dishwashing machine comprising placing soiled dishes and utensils in a dishwashing machine having a washing chamber; removing the container lid and the tab closing the opening in the container top; placing the product in a dishwashing machine with the container top upright and the container and solid detergent block bottoms supported on a foraminous surface with clearance space between the block and container wall; closing the dishwashing machine and supplying washing water to the machine washing chamber as a spray so that water enters the opening in the container top and flows downwardly in the container along the side of the block thereby dissolving some of the detergent and forming a detergent solution which flows out of the container and mixes with water to form a washing solution; and recycling the washing solution into washing contact with the dishes and utensils to clean them.

17 Claims, 1 Drawing Sheet

UNITARY DISHWASHING PRODUCT COMPRISING DETERGENT BLOCK IN CONTAINER AND USE THEREOF

This invention relates to methods of machine washing soiled dishes, table ware, food processing and handling equipment and detergent products useful in such methods.

BACKGROUND OF THE INVENTION

Food processing, preparation, serving and consumption produces large quantities of reuseable soiled dishes, table ware, pots and pans and other equipment often referred to as utensils. Before such items can be reused they must be washed and usually dried. Industrial and institutional cleaning of such goods is generally done in machine washing equipment of various types. However, essentially all washing machines employ an aqueous detergent solution to clean the soiled dishes and other food handling equipment. The aqueous detergent solution is generally sprayed onto the soiled items in an enclosed chamber so that both the solubilizing action of the solution and the mechanical action of the spray against the items combine to clean the soiled dishes and the like.

Restaurants and institutions already have available several types of detergent products for use in dishwashing machines, including granular compositions, liquids, slurries and solid bricks or blocks. Some of these are directly introduced into the machine while others are dispensed automatically by various types of feeding equipment. One type of automatic equipment for producing a detergent washing solution from a solid cast detergent block is disclosed in Fernholz et al U.S. Pat. No. 4,569,781. While it functions satisfactorily it is more complicated than desired by many potential users.

Wertheimer U.S. Pat. No. 2,920,417 discloses a detergent solution dispensing product consisting of an open top cup-shaped receptacle having a cleansing agent cake held therein by a forced fit so that water can not flow along the side of the cake adjacent the receptable wall. A solution of the detergent is produced by supporting the receptable beneath a source of water, such as a faucet. The cake remains firmly located in the receptacle until substantially wholly consumed. The product is apparently not intended for use in a dishwashing machine.

Even though products are available for use in dishwashing machines, it is desired to have availble a readily usable detergent product which provides a controlled supply of a detergent solution, and which is simple to use and is low cost for use in dishwashing machines.

SUMMARY OF THE INVENTION

According to one aspect of the invention there is provided a product comprising a container having a closed top, side wall and open mouth bottom; a removable lid closing the container open mouth bottom; an opening in the container top; means removably closing the opening in the container top; and a solid block detergent composition in the container having a shape conforming to the internal volume defined by the container top and a substantial height of the side wall extending downwardly from the top.

The solid detergent composition can be a monolithic solid formed by casting a liquid detergent composition into the container and solidifying it therein.

The solid can have a bottom surface located above or inwardly of the container open mouth bottom.

The container can be a substantially truncated conical shell wider at the bottom than the top. Such a container can have a thin flexible top, side wall and bottom lid. Desirably, the bottom, side wall and lid can be made of a polymeric material such as polypropylene, polyethylene or other water and detergent resistant material.

The means removably closing the opening in the container top can be a tab covering the hole and adhered to the container top outer surface. The tab can be a thin small sheet of waterproof paper or polymeric material having a pressure sensitive material on one side which will removably adhere to the container top.

The solid detergent desirably adheres to the container internal surface when it is placed therein but is releasable therefrom by tapping the container bottom against an object beneath it. With the lid removed and discarded, this will cause the solid detergent block to drop down onto a supporting foraminous surface with the container surrounding its side and top. When the container is a truncated conical shell or other suitable shape, a clearance space or volume will thereby form between the side of the solid detergent block and the inner surface of the container side wall. This clearance space or volume provides a flow path for water which, with the tab removed, can enter through the hole in the container top and flow downwardly in the clearance space around the detergent block, dissolve detergent and form a washing solution which flows out the bottom to mix with more water in the dishwashing machine.

According to a second aspect of the invention there is provided a method of washing dishes and utensils in a dishwashing machine comprising placing soiled dishes and utensils in a dishwashing machine; manually grasping a product comprising a container having a closed top, side wall and open mouth bottom; a removable lid closing the container open mouth bottom; an opening in the container top; means removably closing the opening in the container top; and a solid block detergent composition in the container having a shape conforming to the internal volume defined by the container top and a substantial height of the side wall extending downwardly from the top; removing the lid and the means removably closing the opening in the container top; placing the manually grasped product in a dishwashing machine with the container top upright and the container bottom and solid detergent block bottom supported on a foraminous surface; closing the dishwashing machine and supplying washing water to the machine washing chamber as a spray so that water enters the opening in the container top and flows downwardly in the container thereby dissolving some of the detergent and forming a detergent washing solution; and recycling the washing solution into washing contact with the dishes and utensils to clean them.

A solid detergent block composition in the form of a monolithic solid formed by casting a liquid detergent composition into the container and solidifying it therein can be used in the described process. The block can also be formed by compressing a mass of powdered or granular detergent into solid form. The solid can have a bottom surface above the container open mouth bottom before it is placed in the dishwasher so that it can drop downwardly a short distance onto the foraminous surface. In so doing, a clearance space develops between the detergent block surface and the container side wall internal surface. The wash water can flow through the clearance space.

The container can be a substantially truncated conical shell wider at the bottom than the top. By tapping the container against the foraminous surface the detergent block can be released from adherence to the container shell and drop down onto the foraminous surface. The desired clearance space for the wash water to flow between the detergent block surface and the container internal surface can be formed automatically in this way.

Controlled dissolution of the solid detergent block is effected in the method by the size of the hole in the container top and also by the container which prevents water from spraying against the side of the detergent block.

The solid detergent block is intended to be used for a plurality of dishwashing machine loadings. The operator need only lift up the container to determine how much of the detergent block remains before initiating another cleaning cycle. If a new block is needed he need only discard the container and insert a new product with the lid removed and the opening in the container top open so that water can flow in.

The composition of the solid detergent block is not narrowly critical. However, it should not be so hard that it dissolves too slowly or be too soft that it dissolves too rapidly. Suitable solid detergent block compositions are already disclosed in the prior art and they can be used in the subject invention as see for example U.S. Pat. Nos. 4,595,520, 4,569,781 and 4,690,770. These patents disclose suitable detergent compositions which form cast solid detergent blocks.

DETAILED DESCRIPTION OF THE DRAWINGS

Figure 1:
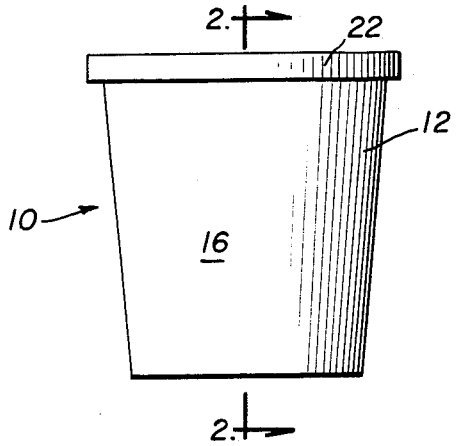
FIG. 1 is an elevational view of the product provided by the invention in inverted non-use or storage position.

To the extent it is reasonable and practical, the same or similar elements appearing in the various views of the drawings will be identified by the same numbers.

The product 10 shown in the drawings includes a container 12 in the form of a shell having a circular top 4, and a truncated conical side wall 16 which terminates in a lower edge 18 which defines an open mouth bottom 20. In designating one end of the container as the top, reference is made to the position of the container when the product is put in use. It should be understood, however, that in manufacturing, storing and shipping the product it will most likely be upside down with the lid uppermost.

A lid 22 snaps or screws onto the lower edge 18 of the side wall 16 with a tight fit yet it is readily removable manually.

The container top 14 is provided with a circular hole 24 which is covered by a tab 26 of polymeric material in the form of a water resistant film having a pressure sensitive adhesive coating which removably adheres the tab to at least part of the outer surface of container top 14 so that the hole 24 is effectively closed.

Figure 2:
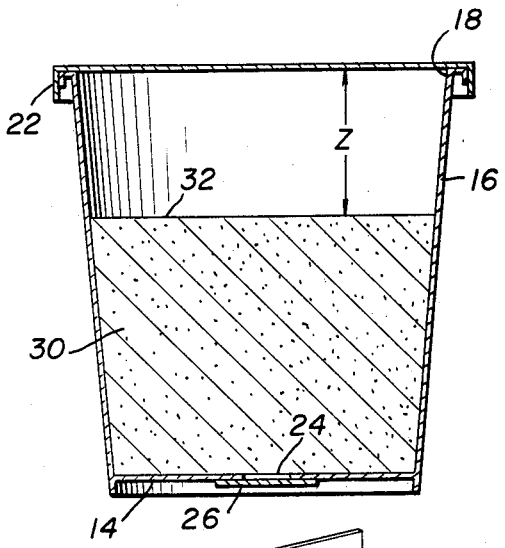
FIG. 2 is a sectional view taken along the line 2—2 of FIG. 1.
Figure 3:
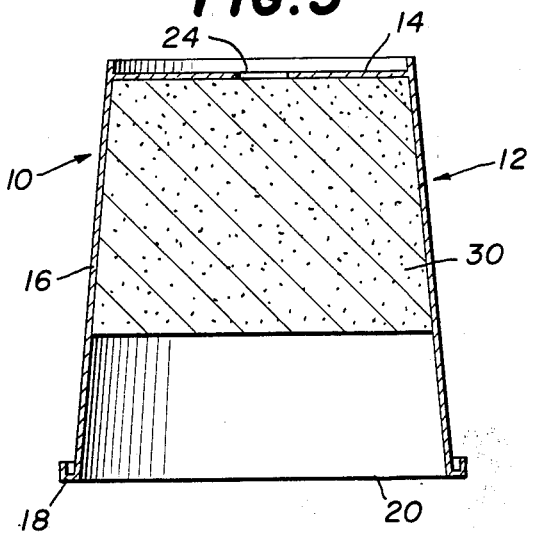
FIG. 3 is a sectional view, similar to FIG. 2, of the product but with the lid and tab removed and in upright position.
Figure 5:
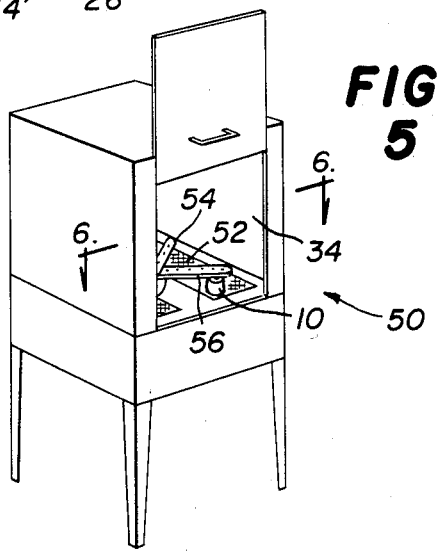
FIG. 5 is an isometric view of a commercial dishwashing machine with the product as shown in FIG. 4 positioned on the scrap tray.
Figure 4:
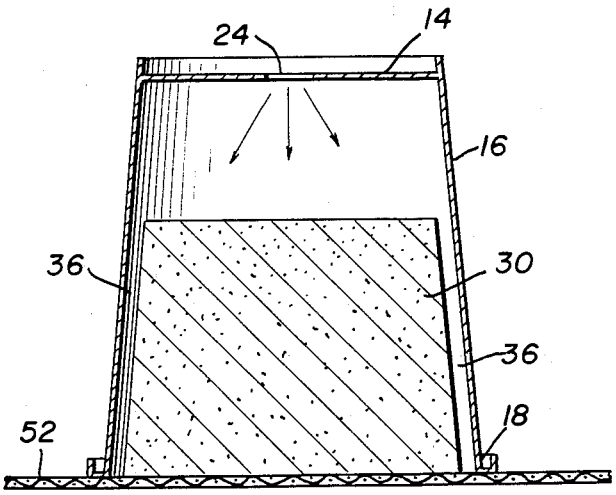
FIG. 4 is a sectional view, similar to FIG. 3, with the product in use position on a scrap tray of a commercial dishwashing machine.
Figure 6:
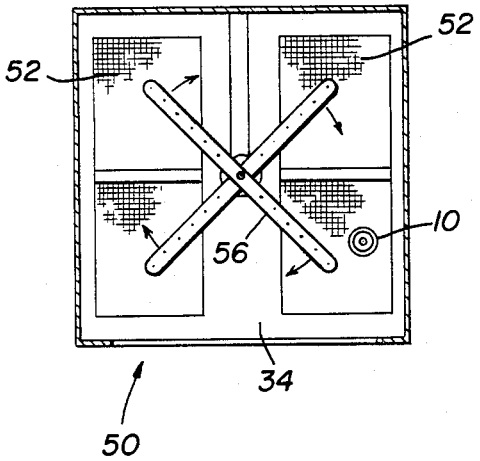
FIG. 6 is a plan view of the inside of the dishwashing machine shown in FIG. 5 with the product on the scrap tray.

Before the lid 20 is placed on the container 12 a detergent composition 30 in the form of a liquid is poured into the container with the container edge 18 uppermost. Sufficient liquid detergent is poured into the container until the liquid surface 32 is a short distance Z (FIG. 2) from edge 18. The lid 22 can be placed on the container before or after the liquid detergent composition solidifies. It may be desirable to let the detergent composition 30 solidify before putting on the lid, especially if the liquid is hot and requires cooling to effect quick solidification. Alternatively, a powder or granular detergent can be put in the container and compressed therein into a solid block.

The detergent product is used by removing the lid 22 and tab 26 and then placing it in the washing chamber 34 of a commercial dishwashing machine 50 on a scrap tray 52 foraminous surface with a firm tap to cause the now solid detergent block 30 to be freed from adherence to the container internal surface and drop down so that the detergent surface 32 rests on and is supported by the scrap tray 52 foraminous surface. When on the scrap tray the product 10 is below the wash water spray arm 54 and below the rinse water spray arm 56. When the dishwashing machine 50 is activated, some of the wash water sprayed upwardly by wash water arm 54 into the washing chamber 34 containing soiled dishes and utensils descends and flows through container hole 22 and then downwardly in the clearance space 36 between the container side wall 16 inner surface and the side surface of the solid detergent block 30. As the water flows against the detergent surface, it dissolves some of the detergent and forms a detergent solution which flows out of the container mouth and mixes with water in the chamber 34 to form a washing solution. The washing solution is removed from a collecting well beneath the scrap tray 52 and recirculated to the chamber 34 as a spray which cleans the soiled dishes and utensils therein by the solubilizing and mechanical impinging action of the washing solution. When the machine is on the rinse cycle some water will flow through container 12 but since the rinse cycle is short little detergent will be used in the rinse step.

The amount of solid detergent block which dissolves is controlled by the size of hole 24 and the container 12 which protects the detergent block 30 against the spray stream directly and forcibly contacting the detergent block surface. It is for this reason that the container is left in the dishwashing machine as the block is consumed. It is intended that one solid detergent block 30 be adequate for a plurality of separate washing machine loads. Once the block is consumed, a new one is placed in the machine.

The following example is presented to further illustrate the invention:

EXAMPLE

A solid detergent block is manufactured having the following composition:

| | Percent |
|---|---|
| 50% Sodium hydroxide, balance water | 12.91 |
| Sodium silicate solution (37.6%) | 24.05 |
| Sodium tripolyphosphate granular | 34.43 |
| Soda ash | 19.43 |
| Sodium sulfate | 1.20 |
| Uranine B dye | 0.02 |
| Terminated polyalkoxylated alcohol | 3.40 |
| Nonylphenoxytetraethoxyethanol | 0.60 |
| Sodium polyacrylate solution (40%) | 3.96 |
| | 100 |

The sodium hydroxide and silicate are combined and heated from 150° F. to 180° F. for 15 minutes. Then the other ingredients are added in the order listed with appropriate stirring. The resulting slurry is cooled to 108° F. and then poured into polymeric containers having a 3 inch diameter circular open mouth, a 2.25 inches closed circular end and a height of about 3 inches. The liquid slurry solidifies in about one-half hour. The solid detergent block formed by solidification of the amount of slurry added to the container is about 2 inches high. It has a truncated conical shape and releasably adheres to the container internal surface. The closed circular end has a centrally located 0.375 inch hole which is covered by a removable tab secured to the end by a pressure sensitive adhesive. The solid detergent block weighs about 9 ounces.

The foregoing detailed description has been given for clearness of understanding only, and no unnecessary limitations should be understood therefrom, as modifications will be obvious to those skilled in the art.

What is claimed is:

1. A product comprising:

a container having a closed top, side wall and open mouth bottom;

a removable lid closing the container open mouth bottom;

an opening in the container top;

means removably closing the opening in the container top; and a solid detergent composition in the container having a shape conforming to the internal volume defined by the container top and a substantial height of the side wall extending downwardly from the top.

2. A product according to claim 1 in which the solid detergent composition is a monolithic solid formed by casting a liquid detergent composition into the container and solidifying it therein.

3. A product according to claim 2 in which the solid has a bottom surface above the container open mouth bottom.

4. A product according to claim 2 in which the container is a substantially truncated conical shell wider at the bottom than the top.

5. A product according to claim 4 in which the container has a thin flexible top, side wall and bottom lid.

6. A product according to claim 5 in which the bottom, side wall and lid are made of a water resistant material.

7. A product according to claim 1 in which the means removably closing the opening in the container top is a tab covering the hole and adhered to the container top outer surface.

8. A product according to claim 2 in which the solid detergent adheres to the container internal surface but is releasable therefrom by tapping the container bottom against an object beneath it.

9. A method of washing dishes and utensils in a dishwashing machine comprising:

placing soiled dishes and utensils in a dishwashing machine having a washing chamber;

manually grasping a product comprising a container having a closed top, side wall and open mouth bottom; a removable lid closing the container open mouth bottom; an opening in the container top; means removably closing the opening in the container top; and a solid block detergent composition in the container having a shape conforming to the internal volume defined by the container top and a substantial height of the side wall extending downwardly from the top;

removing the lid and the means removably closing the opening in the container top;

placing the manually grasped product in a dishwashing machine with the container top upright and the container and solid detergent block bottoms supported on a foraminous surface with clearance space between the block and container wall;

closing the dishwashing machine and supplying washing water to the machine washing chamber as a spray so that water enters the opening in the container top and flows downwardly in the container along the side of the block thereby dissolving some of the detergent and forming a detergent solution which flows out of the container and mixes with water to form a washing solution; and recycling the washing solution into washing contact with the dishes and utensils to clean them.

10. A method according to claim 9 in which the solid detergent composition is a monolithic solid formed by casting a liquid detergent composition into the container and solidifying it therein.

11. A method according to claim 9 in which the solid has a bottom surface above the container open mouth bottom.

12. A method according to claim 9 in which the container is a substantially truncated conical shell wider at the bottom than the top.

13. A method according to claim 12 in which the container has a thin top, side wall and bottom lid.

14. A method according to claim 13 in which the bottom, side wall and lid are made of a water resistant material.

15. A method according to claim 9 in which the means removably closing the opening in the container top is a tab covering the hole and adhered to the container top outer surface.

16. A method according to claim 10 in which the solid detergent adheres to the container internal surface but is releasable therefrom by tapping the container bottom against an object beneath it.

17. A method according to claim 9 in which the solid detergent composition is a compressed powdered or granular detergent composition.

* * * * *